United States Patent [19]

Freberg et al.

[11] Patent Number: 4,710,095

[45] Date of Patent: Dec. 1, 1987

[54] TURBOMACHINE AIRFLOW TEMPERATURE SENSOR

[75] Inventors: Dana D. Freberg, Middletown; William R. Spencer, Springdale, both of Ohio

[73] Assignee: General Electric Company, Cincinnati, Ohio

[21] Appl. No.: 589,866

[22] Filed: Mar. 19, 1984

Related U.S. Application Data

[63] Continuation-in-part of Ser. No. 404,942, Aug. 4, 1982, abandoned.

[51] Int. Cl.[4] ..... F01D 17/08

[52] U.S. Cl. ..... 415/48; 415/118; 374/138; 374/148

[58] Field of Search ..... 374/138, 148

[56] References Cited

U.S. PATENT DOCUMENTS

| | | | |
|---|---|---|---|
| 2,928,279 | 3/1960 | Schober | 374/138 |
| 3,167,960 | 2/1965 | Miesiak | 374/138 X |
| 3,673,870 | 7/1972 | Jalbert | 374/138 |
| 4,403,872 | 9/1983 | DeLeo | 374/138 |

FOREIGN PATENT DOCUMENTS

| | | | |
|---|---|---|---|
| 1413186 | 8/1965 | France | 374/148 |
| 234709 | 1/1979 | U.S.S.R. | 374/138 |

*Primary Examiner*—Everette A. Powell, Jr.
*Attorney, Agent, or Firm*—Derek P. Lawrence

[57] ABSTRACT

A temperature sensor, for measuring the temperature of air flowing in a substantially annular path into a compressor stage of a gas turbine engine, is positioned in proximity to the inner diameter of the annular flow path forward of the compressor stage where the measured temperature of the compressor inlet air is reliable during periods of water ingestion as well as during dry operation.

1 Claim, 5 Drawing Figures

TURBOMACHINE AIRFLOW TEMPERATURE SENSOR

This is a continuation-in-part, of application Ser. No. 404,942, filed Aug. 4, 1982, now abandoned.

BACKGROUND OF THE INVENTION

The present invention relates to gas turbine engines, and more particularly to the measurement of compressor inlet temperatures in such engines.

A current problem existing in sensing compressor inlet temperatures is that during periods of water ingestion by the engine, e.g. during a rainstorm, the sensor gets wet and the sensed temperature approaches the wet bulb temperature which is lower than the actual temperature. As water and air pass through various turbine rotating stages in a substantially annular flow path, the water is centrifuged toward the outer periphery of the annular airstream. Because of this variation in water concentration across the airstream, and the associated heat transfer between the water and the air, a radial temperature distortion is created from the outside to the inside of the annual airstream with cooler temperatures being present at the outer diameter.

Accordingly, it is an object of the present invention to measure the temperature of an airstream flowing in a gas turbine engine at an improved location for operation during dry or wet conditions.

It is another object of the invention to position a temperature sensor at an optimum location within the airstream which reduces the effect of moisture on measurement of compressor inlet temperatures.

It is another object of the invention to improve stall margin in a gas turbine engine during water ingestion.

It is a further object of the invention to improve tracking of variable stator vanes in a gas turbine compressor.

It is an additional object of the invention to provide a temperature sensor which reduces error in the measurement of compressor inlet temperature due to temperature distortions present in an annular airstream.

SUMMARY OF THE INVENTION

A temperature sensing element is mounted within an annular flowpath, having an outer diameter and an inner diameter, of an airstream flowing through a turbomachine, at a location within the annular flowpath which is greater than fifty percent of the radial distance from the outer diameter to the inner diameter.

DETAILED DESCRIPTION OF THE INVENTION

Figure 1:
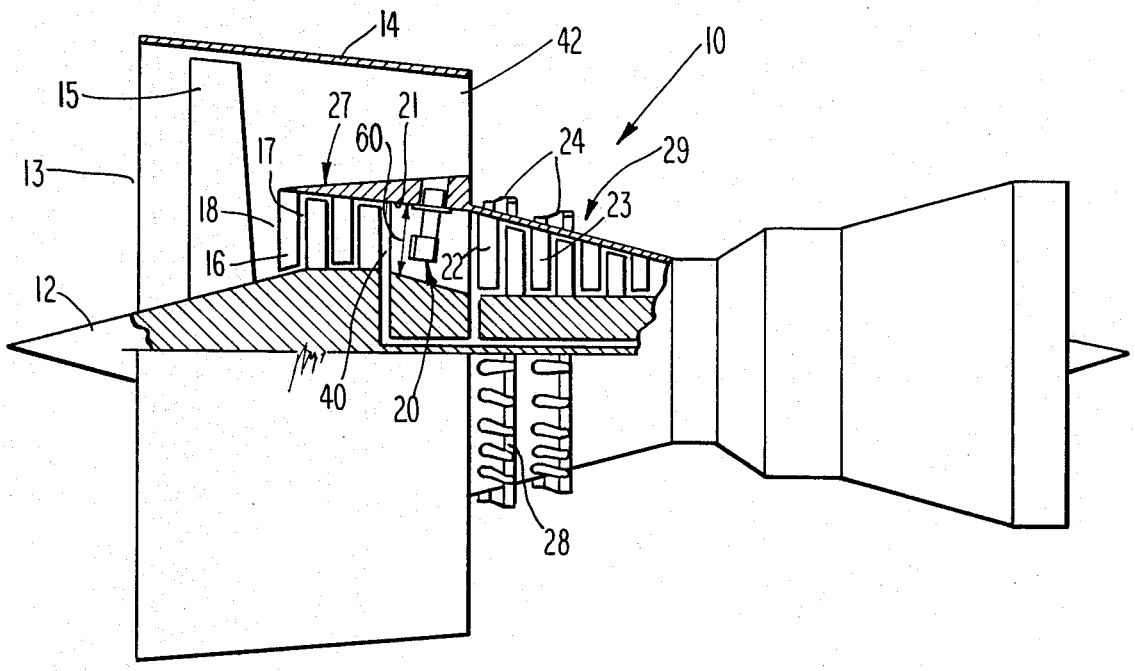
FIG. 1 is a partial sectional view of a gas turbine taken in an axial direction and embodying one form of the present invention.

Referring to FIG. 1 of the drawing, there is depicted a partial sectional view of a gas turbine engine generally referred to as 10. The gas turbine engine 10 comprises an axially extending, cylindrical rotor spool 12 positioned in the center of an air inlet duct 13 surrounded by shroud 14. An engine fan 15 is positioned within the inlet duct 13 for increasing the airstream flow.

Positioned axially behind the engine fan 15 is a booster section portion 17 of the fan rotor including several stages wherein each stage comprises a rotating multi-bladed rotor portion and a nonrotating multi-vane stator portion. The booster section 17 precompresses air pumped from the fan 15 to a pressure ratio of approximately 2:1 or from 14.7 to approximately 29 PSI at sea level. A stator vane 16 in the booster section 17 is positioned at the entrance 18 of an annular flow path 40 for an airstream which flows through turbine 10. The annular flow path 40 is bounded by the rotor spool 12 as an inner boundary or diameter and by surface 21 of air splitter 27 as an outer boundary or diameter. The splitter 27 diverts a portion of the incoming air through a bypass duct 42. Flow path penetration depth is hereinafter referred to as the radial penetration into the annular airflow path 40 from the outer diameter toward the inner diameter. In FIG. 1, arrow 60 represents a penetration depth of 100% since the arrow extends all the way from the outer diameter to the inner diameter.

Spaced axially and rearwardly of the booster section 17 in gas turbine 10 is a multi-stage high pressure compressor 29. The high pressure compressor 29 includes a plurality of rotating multi-bladed rotors, and non-rotating, variable position multi-vane stators. The stator vanes, such as vanes 22 and 23, are attached to actuator arms 24 which are connected to hoops 28 to permit the angle of attack of the stator vanes to be varied in accordance with certain turbine operating parameters. Use of the variable position stator vanes is well known in the art and a description of such operation may be found in U.S. Pat. No. 2,931,168, which patent is incorporated by reference as if fully set forth herein. Air is pumped axially through the high pressure compressor 29 which increases the pressure and temperature of the air for use in a combustion section (not shown) of the turbine engine 10.

Located within the annular flow path 40, off of the booster section 17 and forward of the high pressure compressor 29, is a temperature sensor 20, for determining compressor inlet temperature. Sensor 20, which is shown isometrically in FIG. 2, comprises a strut 32 one end of which is attached to a flange 36. The opposite end of the strut 32 is attached to a casing 26 within which is located a helium filled coil 38 (see also FIG. 3). The flange 36 is attached to the inner surface 21 of splitter 27. The length of the strut is selected such that the casing 26, containing the temperature sensing coil 38, is positioned within the annular flow path 40 at a penetration depth which is greater than 50% of the total penetration depth 60 as will be subsequently described.

Figure 2:
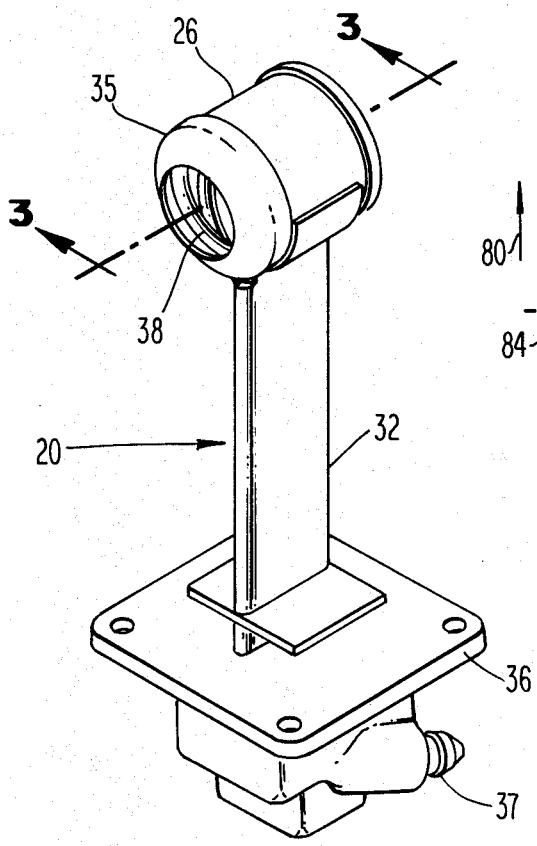
FIG. 2 is an isometric view of a deep immersion temperature sensor incorporated in FIG. 1.
Figure 3:
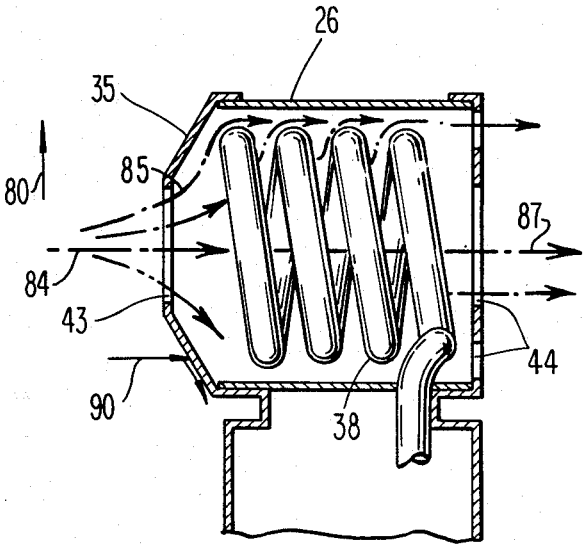
FIG. 3 is a sectional view taken on line 2—2.

FIG. 3 depicts the casing 26 with a conically shaped rainshield 35 having an opening 43 enabling air to flow past coil 38 and exit through opening 44. The rainshield 35 allows the air to freely pass over surfaces of the coil 38 by formation of eddy currents within casing 26, while blocking rain droplets that are present during water ingestion conditions. Further, water which is ingested through the opening 43 in FIGS. 2 and 3 is filtered from the incoming air. The incoming air enters the opening at a speed of about 0.4 to 0.5 Mach (in excess of about 400 feet per second) during flight. The conical shield 35 surrounding the opening 43 acts as a diffuser to the incoming air (because the cross-sectional area of the flowpath increases in the direction of flow) and thus imparts a radial component of acceleration 80 to both the entering air and water. The term "radial" refers to a radial direction with respect to the axis 84 of the helical coil 38; i.e., the radial direction is normal (i.e., perpendicular) to the axis 84.

However, the air the water droplets have different specific gravities and will accordingly experience different radial accelerations. The air accelerates rapidly and follows path 85, while the water (or ice) generally follows path 87. That is, the more dense particulate matter (water or ice) shoots almost directly through the coil 38, while the less dense air turns and swirls about the coil 38. Thus, the coil 38 registers the temperature of the filtered, dried air and not a wet bulb temperature. Of course, the water must have a specific gravity greater than that of the incoming air: water in the vapor state would not be filtered out.

Characterized another way, the incoming airstream is generally parallel with the axis 84 of the helical coil. The diffusing action of the conical shield 35 imparts an acceleration to the airstream which is radially outward from the axis 84. The radial force imparts a differential acceleration to the denser, particulate matter than to the air, thus filtering the particulates from the air.

Characterized in still another way, the conical shield 35 is a truncated cone and the truncation forms the opening 43. The axis of the conical shield 35 (not specifically shown) coincides with the axis 87 of the cylindrical chamber 26. The conical shield 35 blocks incoming streamlines such as streamlines 90 in FIG. 3 so that these streamlines cannot flow parallel to the axis 87 entering the chamber and in striking the helical coil 38. Streamlines which do strike the helical coil 38 (such as streamline 85) must acquire a radial component of velocity after passing through the opening 43. The sensing coil 38 is filled with helium gas under pressure and reacts to temperature changes such that when the temperature increases, the gas pressure increases, and when the temperature decreases the gas pressure also decreases. The changes of pressure of the gas within sensing coil 38 are coupled through connector 37 to an appropriate control mechanism. The rainshield aids in sensing the actual temperature of the airstream by minimizing moisture contact on coil 38, thereby preventing the sensed temperature from approaching the wet bulb temperature which is less than the actual air temperature.

In a preferred embodiment installation, the flow path penetration depth of the sensing coil 38 is approximately 4.5 inches from inner surface 21. Since, in this exemplary embodiment, the annular air path 40 has a total penetration depth of 8 inches (100% penetration depth), the position of the sensing coil 38 represents approximately a 55% penetration depth into the annular path 40 from the inner surface 21. The 55% penetration depth position of coil 38 represents a location where the air is warmer during water ingestion than in the vicinity of inner surface 21 of splitter 27 (0% penetration depth) where water has been centrifuged by the rotating stages of the fan 15 and booster section 17.

Figure 4:
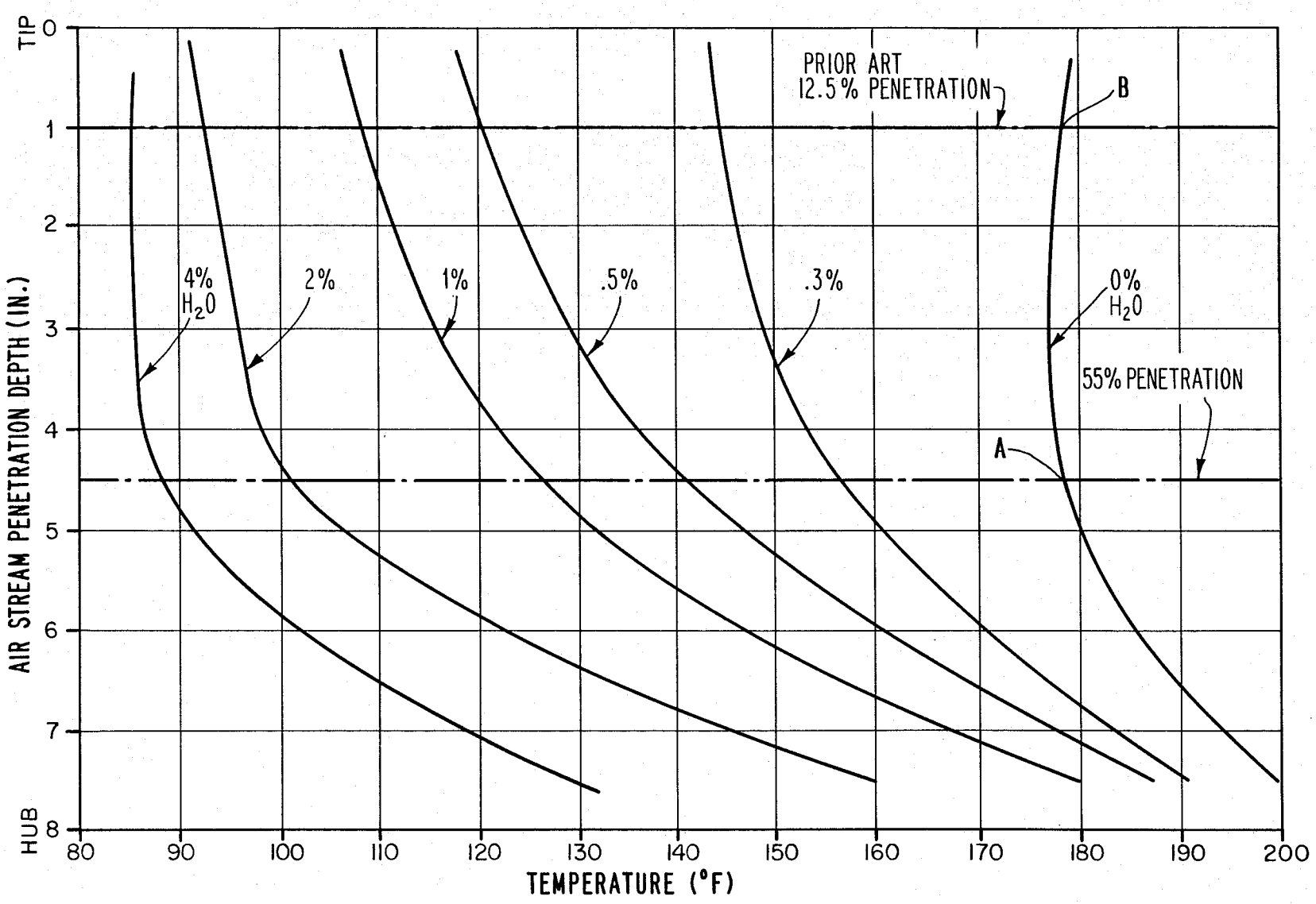
FIG. 4 is a graph showing temperature variations in a turine airstream with various moisture content and different airstream penetration depths.

FIG. 4 depicts various curves plotting flow path penetration depth (in inches) vs. temperature (in degrees Farenheit) taken at the inlet of the high pressure compressor. Each curve represents a different percentage of moisture content present in the airstream. By referring to the 0% moisture curve, it is shown that the 55% penetration depth position (indicated by "A") results in a temperature reading which is substantially equal to the temperature reading obtained at the prior art 12.5% penetration depth position (indicated by "B"). However, for other percentages of moisture in the airstream, it is clear that the 55% penetration depth position results in warmer temperature measurements than those measurements taken at the prior art 12.5% penetration depth position. These warmer temperatures more closely approximate the actual inlet temperatures than do the cooler temperatures measured at the prior art penetration depth position due to the radial temperature gradient imparted by the centrifuged water droplets.

It should be apparent from this detailed description that if even warmer temperature detection is desired, it is only necessary to increase the penetration depth position of the sensing coil 38; that is, to position the coil 38 closer to rotor spool 12. This would simply require that the strut 32 of temperature sensor 20 be lengthened for still deeper penetration of the coil 38 into the flow path 40. As shown in the family of curves in FIG. 4, the airstream temperature begins to noticeably increase at penetration depths greater than 50%. This increase becomes even more apparent as moisture content of the airstream increases. Consequently, placement of the sensor coil 38 at a penetration depth which exceeds 50% of the total penetration depth available will permit the measurement of the warmer temperatures actually present in the airstream. It is preferred that the sensor coil be positioned at a penetration depth in the range of 55% to 85% of the total penetration depth of the flow path.

Figure 5:
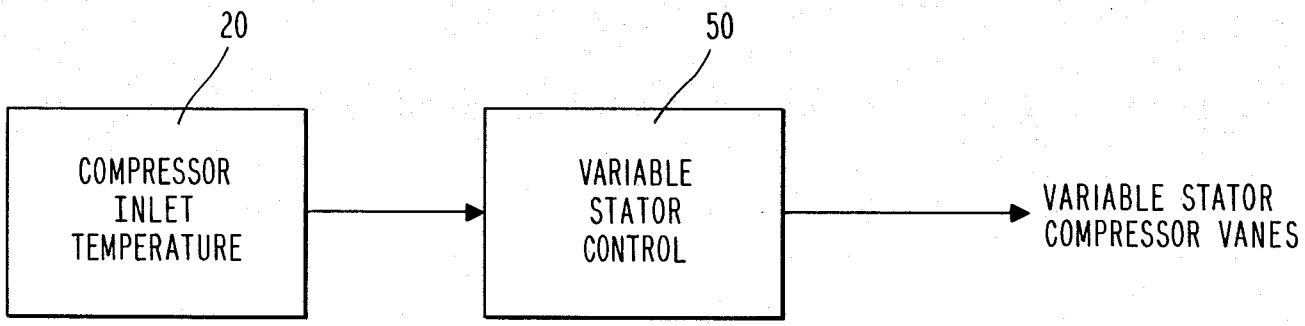
FIG. 5 is a block diagram depicting system operation of the present invention in a gas turbine having variable compressor vanes.

FIG. 5 illustrates in block diagram form that the output signal from the sensor 20, which is a function of compressor inlet temperature, is directed into a variable stator control system 50. The control system 50 produces an output signal which is used to position the variable stator vanes, for example those identified in FIG. 1 by reference numerals 22 and 23, by way of hoops 28 and actuator arms 24 in accordance with the compressor inlet temperature, as shown and described in U.S. Pat. No. 2,931,168 which has been incorporated by reference in this detailed description as if fully set forth herein.

By accurately sensing the temperature in the airstream of flow path 40 during rainstorms by use of deep immersion sensing and use of a rainshield 35, the variable stator vanes of the compressor 29 are further closed by several degrees. As a result, the angle of attack of the variable stator vanes are oriented such that the high pressure compressor 29 pumps air axially through turbine 10 in an efficient manner and with a reduction in turbulence. Hence, the stall margin of the compressor 29 is enhanced.

Although the embodiment of the invention described heretofore involves a temperature sensor position forward of the high pressure compressor, the present invention is also useful for measuring temperatures at other locations in the gas turbine engine where rotating blades cause radial temperature distortions. For example, the sensor may be positioned between the fan and the booster section of the gas turbine engine; forward of the high pressure turbine; forward of the low pressure turbine; or even at some intermediate interstage position. Consequently, such locations are considered to be encompassed within the scope of the present invention.

It will be understood that the foregoing suggested apparatus as exemplified by the Figures, is intended to be illustrative of a preferred embodiment of the subject invention and that many options will readily occur to those skilled in the art without departure from the spirit of the scope of the principles of the subject invention.

We claim:

1. An apparatus for sensing the dry bulb temperature of a fluid stream having a gaseous phase and a liquid phase, comprising:

a hollow generally cylindrical member having a first radius;

a means for admitting a fluid stream having a gaseous phase and a liquid phase into the cylindrical member, comprising a generally circular opening in one end of the cylindrical member having a second radius smaller than the first radius, the opening being capable of admitting a fluid stream into the cylindrical member along the longitudinal axis of the member such that the fluid stream is accelerated away from the axis, the acceleration of the gaseous phase being greater than that of the liquid phase; and a means for sensing the dry bulb temperature of the fluid stream admitted into the hollow member, comprising a temperature sensor located inside the cylindrical member a distance away from the axis between the first and second radii, the path between the axis and the temperature sensor being unobstructed along substantially the entire length of the axis inside the cylindrical member.

* * * * *